US009278440B2

(12) United States Patent
Aron

(10) Patent No.: US 9,278,440 B2
(45) Date of Patent: Mar. 8, 2016

(54) BUSHING REMOVAL DEVICE

(71) Applicant: Antonelli T. Aron, Anchorage, AK (US)

(72) Inventor: Antonelli T. Aron, Anchorage, AK (US)

( * ) Notice: Subject to any disclaimer, the term of this patent is extended or adjusted under 35 U.S.C. 154(b) by 118 days.

(21) Appl. No.: 14/231,950

(22) Filed: Apr. 1, 2014

(65) Prior Publication Data

US 2015/0273673 A1 Oct. 1, 2015

(51) Int. Cl.
*B25B 27/06* (2006.01)

(52) U.S. Cl.
CPC ..... *B25B 27/06* (2013.01); *Y10T 29/5383* (2015.01)

(58) Field of Classification Search
CPC ..... B25B 27/064; Y10T 29/5383
USPC ..... 29/252
See application file for complete search history.

(56) References Cited

U.S. PATENT DOCUMENTS 3,267,568 A * 8/1966 Johnson ..... F16K 1/32 29/213.1
4,586,229 A * 5/1986 Pendola ..... B25B 27/064 29/252
4,610,066 A * 9/1986 Cline ..... B25B 27/026 29/244
4,967,460 A * 11/1990 Runyan ..... B25B 27/064 29/252
5,168,623 A * 12/1992 Rabe ..... B23P 19/025 269/48.1
5,232,069 A * 8/1993 Siegrist ..... F16N 21/02 184/105.3
6,886,227 B1 * 5/2005 Hedrick ..... B25B 27/02 29/252
2007/0245563 A1 * 10/2007 Smith ..... B23P 19/025 29/898.08

* cited by examiner

*Primary Examiner* — Lee D Wilson
*Assistant Examiner* — Henry Hong
(74) *Attorney, Agent, or Firm* — Dale J. Ream

(57) ABSTRACT

A bushing removal device for removing a pilot bushing from a crankshaft cavity includes a casing defining a threaded bore extending into the casing. A grease fitting is coupled to an outer wall of the casing and configured to receive an infusion of grease. The casing includes a grease channel in communication with the grease fitting and with a grease channel outlet situated at the threaded bore. A nozzle includes opposed proximal and distal ends, the proximal end having a threaded configuration received into the casing threaded bore. The nozzle includes a grease conduit having a grease conduit inlet at the proximal end that is in communication with the casing grease channel when the nozzle is coupled to the casing and having a grease conduit outlet at the distal end of the nozzle. The casing and nozzle also include air channels and valve for exhausting air from the crankshaft cavity.

11 Claims, 8 Drawing Sheets

BUSHING REMOVAL DEVICE

BACKGROUND OF THE INVENTION

This invention relates generally to automotive tools and, more particularly, to a device for removing a pilot bushing or needle bearing from a crankshaft cavity. The bushing removal device is configured to inject grease into the cavity so as to increase removal pressure on a bushing being removed.

Removing a needle bearing or pilot bushing from a crankshaft is often a difficult procedure for an automobile technician or mechanic although it is not uncommon. A pilot bushing is important in that it may align and support a vehicle's input shaft. Another description of the role of a pilot bushing is that it allows the transmission input shaft—which extends into the engine crankshaft—to rotate independently. Sometimes the pilot bushing must be replaced or repaired.

A significant difficulty with removing a pilot busing or bearing is that there is no reliable means for grasping it with a tool and no good way to leverage enough force to remove the bearing from an interior space defined by conventional crankshaft. Therefore, it would be desirable to have a pilot bushing removal tool that directs grease behind a pilot bushing installed in a crankshaft cavity until an increased pressure of the inserted grease causes an outward "pushing" of the bushing or bearing out of the interior space. Further, it would be desirable to have a pilot bushing removal tool that that may be coupled to a grease gun or other source of grease to be injected through a nozzle and that removes air from accumulated grease so as maximize the pressure.

SUMMARY OF THE INVENTION

A bushing removal device for removing a pilot bushing from a crankshaft cavity of an engine according to the present invention includes a casing having opposed front and rear ends, the front end defining a threaded bore extending into the casing. A grease fitting is coupled to an outer wall of the casing and configured to receive an infusion of grease. The casing includes a grease channel in communication with the grease fitting and with a grease channel outlet situated at the threaded bore. A nozzle includes opposed proximal and distal ends, the proximal end having a threaded configuration complementary to the threaded bore of the casing and selectively received therein. The nozzle includes a grease conduit having a grease conduit inlet at the proximal end that is in communication with the grease channel of the casing when the nozzle is coupled to the casing and having a grease conduit outlet at the distal end of the nozzle.

The bushing removal device includes an air release valve coupled to the outer wall of the casing and extending into the casing, the air release valve being in communication with an air release exit port situated in the outer wall and in communication with an air channel outlet situated adjacent the threaded bore. The nozzle includes an air conduit inlet situated at the proximal end that is in communication with the air channel outlet of the casing when the nozzle is coupled to the casing and having an air conduit outlet at the distal end of the nozzle.

Therefore, a general object of this invention is to provide a bushing removal device that utilizes an injection of grease to more efficiently remove a pilot bushing or needle bearing from a crankshaft cavity.

Another object of this invention is to provide a bushing removal device, as aforesaid, that injects a sufficient volume of grease behind the bushing such that sufficient pressure is exerted to push the bushing out of the cavity.

Still another object of this invention is to provide a bushing removal device, as aforesaid, that evacuates air from the space into which grease is injected so as to efficiently generate the pressure needed to push out the bushing.

Yet another object of this invention is to provide a bushing removal device, as aforesaid, that may be operatively coupled to a grease gun.

A further object of this invention is to provide a bushing removal device, as aforesaid, that is user-friendly to operate.

A still further object of this invention is to provide a bushing removal device, as aforesaid, that is durable and able to withstand an impact by a hammer so as to increase pressure on a bearing being removed.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
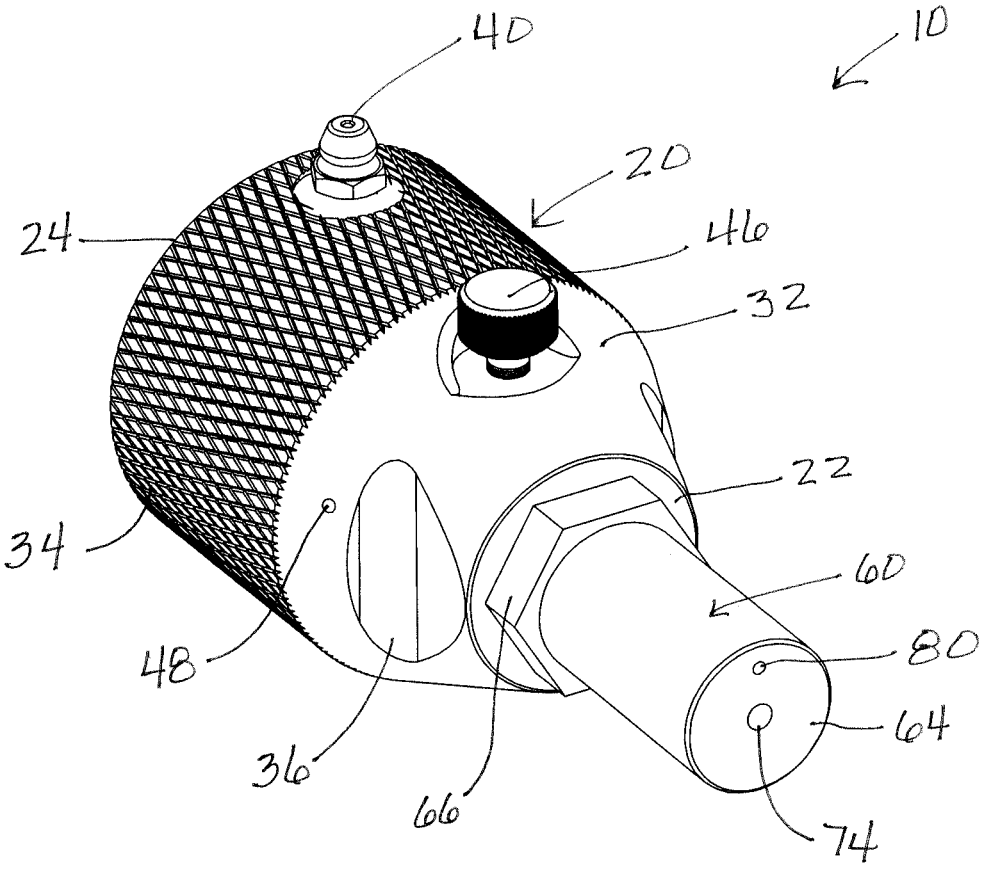
FIG. 1 is a perspective view of a bushing removal device according to a preferred embodiment of the present invention.

A bushing removal device for removing a pilot bushing from a crankshaft cavity will now be described with reference to FIGS. 1 to 5*c* of the accompanying drawings. The bushing removal device 10 includes a casing 20 and a nozzle 60.

The casing 20 includes a front end 22 and a rear end 24. The front end 22 includes a threaded bore 26 extending rearwardly into the casing 20. The casing 20 includes a solid interior except as described otherwise below. The rear end 24 of the casing 20 has a generally planar rear wall 28 that is capable of receiving an impact force, such as from a hammer or mallet. The casing 20 includes a continuous outer side wall 32 that is generally cylindrical. A rubber material 34 may be situated on an outer surface of the side wall 32 so as to provide an enhanced grip by a user's hand.

A grease fitting 40 is situated on the outer wall of the casing 20 and is configured to receive an infusion of grease from a grease gun (not shown). The casing 20 includes a grease channel 42 extending through the interior of the casing 20, the grease channel 42 being in communication with the grease fitting 40 (FIG. 3*d*). The grease channel 42 is in communication with a grease channel outlet 44 adjacent the threaded bore 26.

An air release valve 46 is coupled to the outer wall of the casing 20 and extends into the casing interior. The air release valve 46 is in communication with an air release exit port 48 (FIG. 4*c*) and is also in communication with an air channel 50 situated adjacent the outer bore 26 of the casing 20 (FIG. 3*d*). An air channel outlet 52 is positioned adjacent the threaded bore 26. These structures will enable air in the area of the bushing 12 to be evacuated in conjunction with infusion of grease as will be described later.

The nozzle 60 includes opposed proximal 62 and distal 64 ends (FIG. 2*e*), the proximal end 62 having a outwardly threaded configuration complementary to the threaded bore 26 of the casing 20. In addition, the threaded end of the nozzle 60 includes an outside diameter that is complementary to an inside diameter of the threaded bore 26 so as to be selectively and threadably received into the threaded bore 26 (FIG. 2*e*). In one embodiment, multiple nozzles may be included, each having a different outside diameter for use with removing bushings 12 having other diameters. While the threaded proximal end 62 would have a uniform diameter, the remainder of the nozzle may have a different diameter.

The nozzle 60 includes complementary structures to those of the casing 20 for the communication of grease and air. More particularly, the nozzle 60 includes a grease conduit 70 extending longitudinally therethrough between proximal 62 and distal 64 ends. The grease conduit 70 includes a grease conduit inlet 72 in communication with the grease channel outlet 44 of the casing 20 when the nozzle 60 is coupled to the threaded bore 26. The grease conduit 70 is in communication with a grease conduit outlet 74 adjacent the distal end 64 of the nozzle 60. In use, these structures enable grease infused into the grease fitting 40 by a grease gun to be transferred through the grease channel 42 of the casing and through the grease conduit 70 of the nozzle 60. The grease will be directed into the cavity 16 of the crankshaft 14 as will be described later.

The nozzle 60 also includes an air conduit 76 having an air conduit inlet 78 situated at the proximal end 62 that is in communication with the air channel outlet 52 of the casing 20 when the nozzle 60 is threadably received in the threaded bore 26 of the casing 20. The nozzle 60 includes an air conduit outlet 80 adjacent the distal end 64 of the nozzle 60 that is in communication with the air conduit 76. In use, these structures enable air from the crankshaft cavity 16 to be forced through the air conduit 76, air channel 50, and out the air release exit port 48 so long as the air release valve 46 is properly opened.

The otherwise cylindrical casing 20 includes a pair side walls defining recessed areas 36 being configured to receive respective jaws of a wrench (not shown). It is understood that in the event that the nozzle 60 were to get stuck inside the crankshaft cavity 16, a wrench may be used to impart sufficient torque on the casing 20 to dislodge the nozzle 60.

The nozzle 60 has a generally cylindrical configuration having a predetermined outside diameter that is complementary and slightly smaller that inner diameter of the pilot bushing 12. Accordingly, the nozzle 60 is selectively received into the interior space of the cylindrical pilot bushing 12.

In another aspect of the invention, the removal device 10 may include an elongate strap 90 having opposed ends 92 and a generally linear configuration. The strap 90 may be used to keep the casing 20 stable and in position without being held by a user, such as when a user may choose to strike the rear wall 28 with a hammer, as will be described below. Each end 92 may have a loop configuration to enable the strap ends to be coupled to frame member of the vehicle or to engine components. In addition, the strap 90 may have a midsection 94 particularly configured to bear against the rear wall 28 when the ends are coupled to respective frame members. Further, the rear wall 28 of the casing 20 defines a plurality of notches 30 that are configured to guide and stabilize the midsection 94 of the strap 90 when the strap 90 is positioned to bear against the rear wall 28.

The nozzle 60 may include a shank having a hexagonal configuration (also referred to as a hex shank). The hex shank 66 may extend radially about the nozzle 60 and be displaced from the proximal end 62 of the nozzle 60. The hex shank 66 includes an outer diameter that is larger than the inside diameter of the pilot bushing 12 such that the nozzle 60 may not be over-inserted into the cavity 16 and interior space of the bushing 12.

In use, the bushing removal device 10 can be used to remove a pilot bushing 12, sometimes called a needle bearing, from a cavity of a crankshaft of an automobile transmission. A pilot bushing 12 may be difficult to remove in that there is no good way to grasp it and pull it out of the cavity. However, the bushing removal device 10 is advantageously configured to use the pressure of inserted grease to push the bushing 12 out as described below.

Figure 2A:
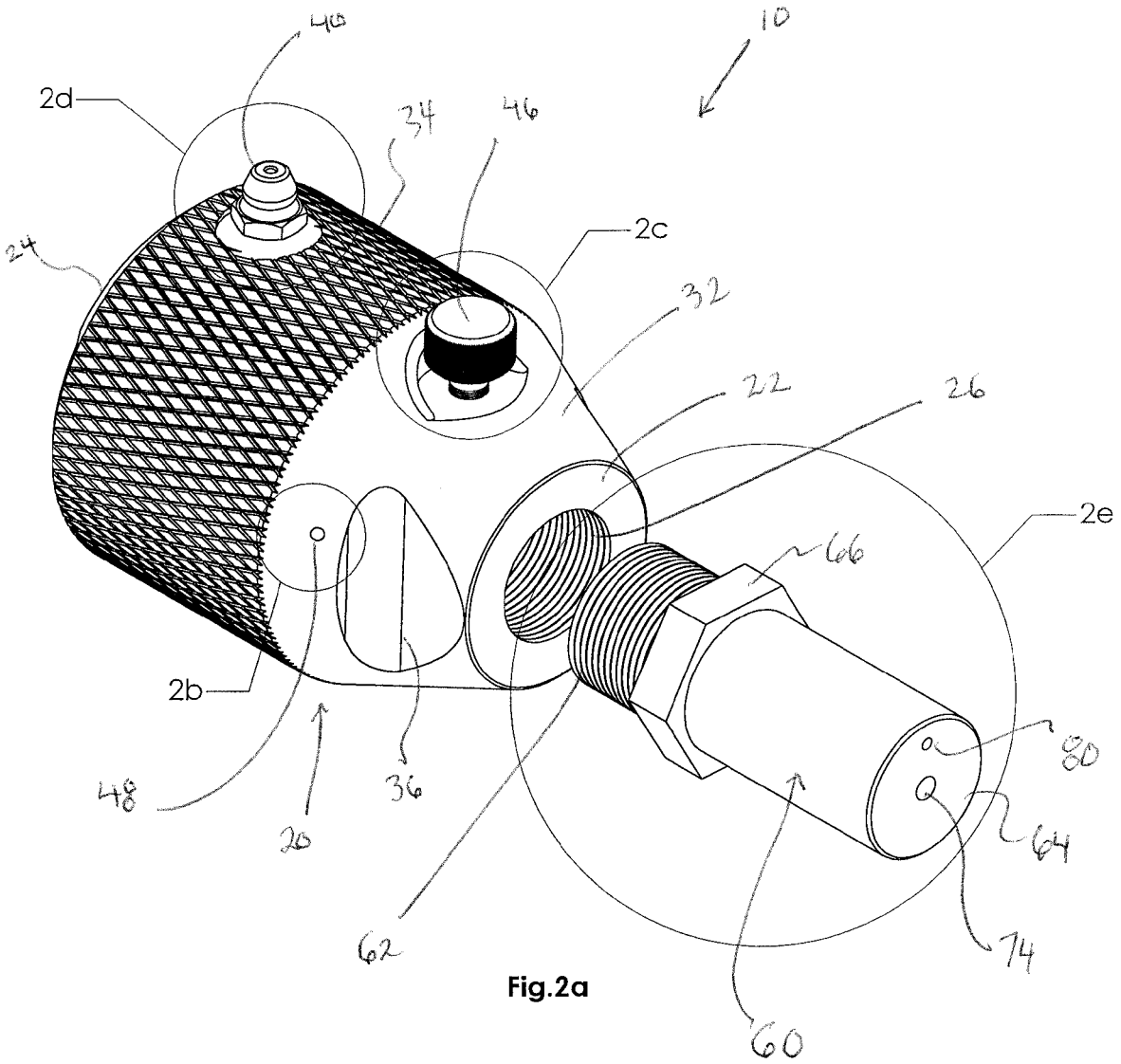
FIG. 2*a* is an exploded view of the bushing removal device as in FIG. 1
Figure 2B:
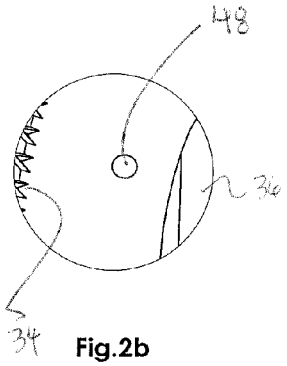
FIG. 2*b* is an isolated view on an enlarged scale of a portion of the bushing removal device as in FIG. 2*a;*
Figure 2C:
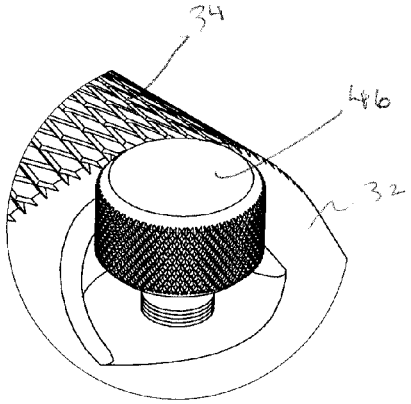
FIG. 2*c* is an isolated view on an enlarged scale of a portion of the bushing removal device as in FIG. 2*a;*
Figure 2D:
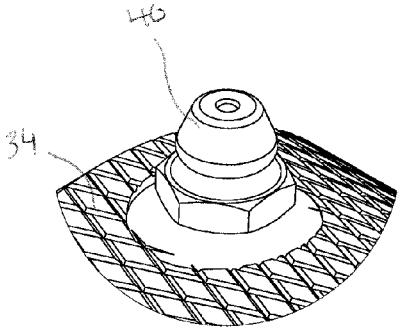
FIG. 2*d* is an isolated view on an enlarged scale of a portion of the bushing removal device as in FIG. 2*a;*
Figure 2E:
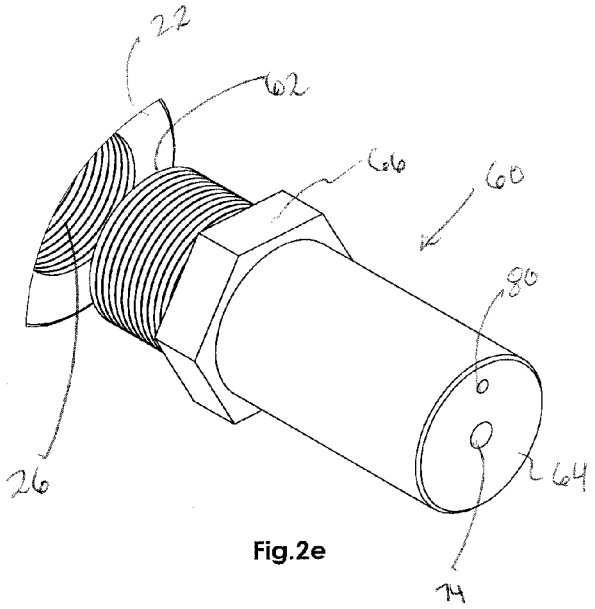
FIG. 2*e* is an isolated view on an enlarged scale of a portion of the bushing removal device as in FIG. 2*a;*

First, the threaded proximal end 62 of the nozzle 60 is threadably inserted into the threaded bore 26 of the casing 20 (FIG. 2*a*). Then the distal end 64 of the nozzle 60 is inserted into the interior space of the crankshaft cavity 16 and bushing 12 (FIG. 3*b*). The nozzle 60, however, should not be inserted all the way to the end of the bushing 12. The air release valve 46 should be opened part or all the way so as to allow air pushed out of the cavity 16 to be exhausted through the air release exit port 48. Then, a grease gun may be connected to the grease fitting 40 and grease infused into the grease channel 42. More grease is infused and communicated through the grease channel 42 and grease conduit 70 as described above. The grease then exits the nozzle 60 and fills the cavity 16 surrounding the bushing 12. The grease displaces air and the air is, as a result, communicated through the air conduit 76 and air channel 50 and exhausted out of the air release exit port 48.

Figure 5A:
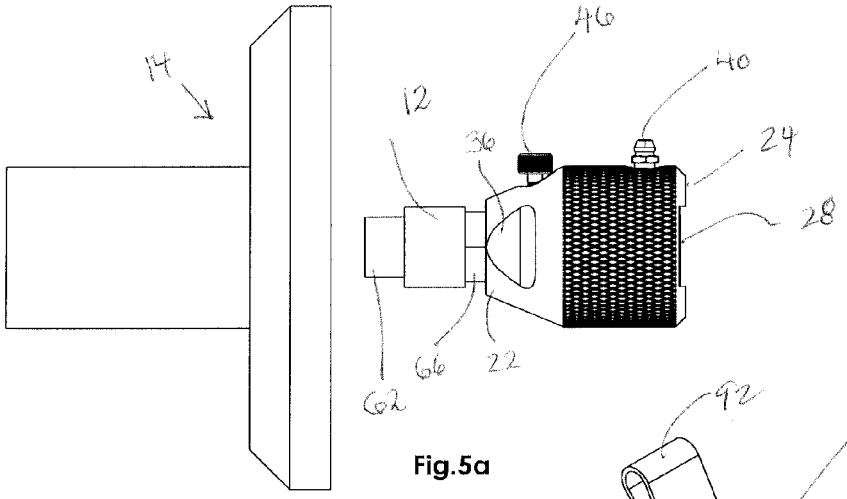
FIG. 5*a* is a side view of the bushing removal device as in FIG. 2*a;*

If grease is returned through the air channel 50, then a user can be confident all of the air has been evacuated and the air valve 46 may be closed. More grease can be pushed into the cavity 16 so as to increase pressure on the bushing 12 to be pushed out of the cavity 16. If the bushing 12 is stuck, a user may strike the rear wall 28 of the casing 20 with a mallet or hammer to increase the pressure even more. A successful removal will result in the bushing 12 being received onto the outer surface of the nozzle 60 as shown in FIG. 5*a*.

It is understood that while certain forms of this invention have been illustrated and described, it is not limited thereto except insofar as such limitations are included in the following claims and allowable functional equivalents thereof.

The invention claimed is:

1. A bushing removal device for removing a pilot bushing from a crankshaft cavity in which a pilot bushing defining an interior space having a predetermined inner diameter is situated, comprising:

a casing having opposed front and rear ends, said front end defining a threaded bore extending into said casing;

a grease fitting coupled to an outer wall of said casing and configured to receive an infusion of grease;

wherein said casing includes a grease channel in communication with said grease fitting and with a grease channel outlet positioned at said threaded bore; and a nozzle having a opposed proximal and distal ends, said proximal end having a threaded configuration complementary to said threaded bore of said casing and selectively received therein;

wherein said nozzle includes a grease conduit having a grease conduit inlet at said proximal end that is in communication with said grease channel outlet of said casing when said nozzle is coupled to said casing and having a grease conduit outlet at said distal end of said nozzle.

2. The removal device as in claim 1, comprising:

an air release valve coupled to said outer wall of said casing and extending into said casing, said air release valve being in communication with an air release exit port situated in said outer wall and in communication with an air channel outlet situated adjacent said threaded bore; and wherein said nozzle includes an air conduit inlet situated at said proximal end that is in communication with said air channel outlet of said casing when said nozzle is coupled to said casing and having an air conduit outlet at said distal end of said nozzle.

3. The removal device as in claim 2, wherein said nozzle has a cylindrical configuration having a predetermined outer diameter that is complementary and smaller than the inner diameter of the pilot bushing such that said distal end of said nozzle is selectively received into an open interior space of the pilot bushing.

4. The removal device as in claim 1, wherein said casing has a generally solid interior and includes a rear wall configured to withstand an impact force.

5. The removal device as in claim 4, wherein said casing includes a continuous side wall having a generally cylindrical configuration, said side wall including a rubber material configured to enhance grip thereon.

6. The removal device as in claim 5, wherein said casing includes opposed side walls defining recessed areas having planar surfaces, respectively, adjacent said front end, said recessed areas being configured to receive respective jaws of a wrench.

7. The removal device as in claim 6, wherein said nozzle has a cylindrical configuration having a predetermined outer diameter that is complementary and smaller than the inner diameter of the pilot bushing such that said distal end of said nozzle is selectively received into an open interior space of the pilot bushing.

8. The removal device as in claim 4, comprising an elongate strap having opposed ends and a linear configuration, said strap having a midsection configured to engage said rear wall of said case and each end of said strap being configured to attach to a vehicle frame or engine so as to secure said casing in a stationary position relative to the crankshaft cavity.

9. The removal device as in claim 8, wherein said rear wall of said casing defines a plurality of spaced notches that are configured to guide and stabilize said midsection of said strap when said strap is positioned to bear against said rear wall.

10. The removal device as in claim 1, wherein said nozzle has a cylindrical configuration having a predetermined outer diameter that is complementary and smaller than the inner diameter of the pilot bushing such that said distal end of said nozzle is selectively received into an open interior space of the pilot bushing.

11. The removal device as in claim 1, wherein said nozzle includes a shank having a hexagonal configuration extending radially about said nozzle at a position displaced form said proximal end thereof, said shank having an outer diameter larger than the inner diameter of the pilot bushing interior space so as to prevent the nozzle from being over-inserted into the interior space of the pilot bushing.

* * * * *

UNITED STATES PATENT AND TRADEMARK OFFICE

CERTIFICATE OF CORRECTION

PATENT NO. : 9,278,440 B2
APPLICATION NO. : 14/231950
DATED : March 8, 2016
INVENTOR(S) : Antonelli T. Aron It is certified that error appears in the above-identified patent and that said Letters Patent is hereby corrected as shown below:

On the title page, replace the informal drawing with the formal drawing of Fig. 1.

Drawings

On drawing Sheet 1 of 8, replace the informal drawing of Fig. 1 with formal drawing of Fig. 1. (Attached)

On drawing Sheet 2 of 8, replace the informal drawing of Fig. 2a with formal drawing of Fig. 2a. (Attached)

On drawing Sheet 3 of 8, replace the informal drawing of Figs. 2b-2e with formal drawing of Figs. 2b-2e. (Attached)

Figure 3A:
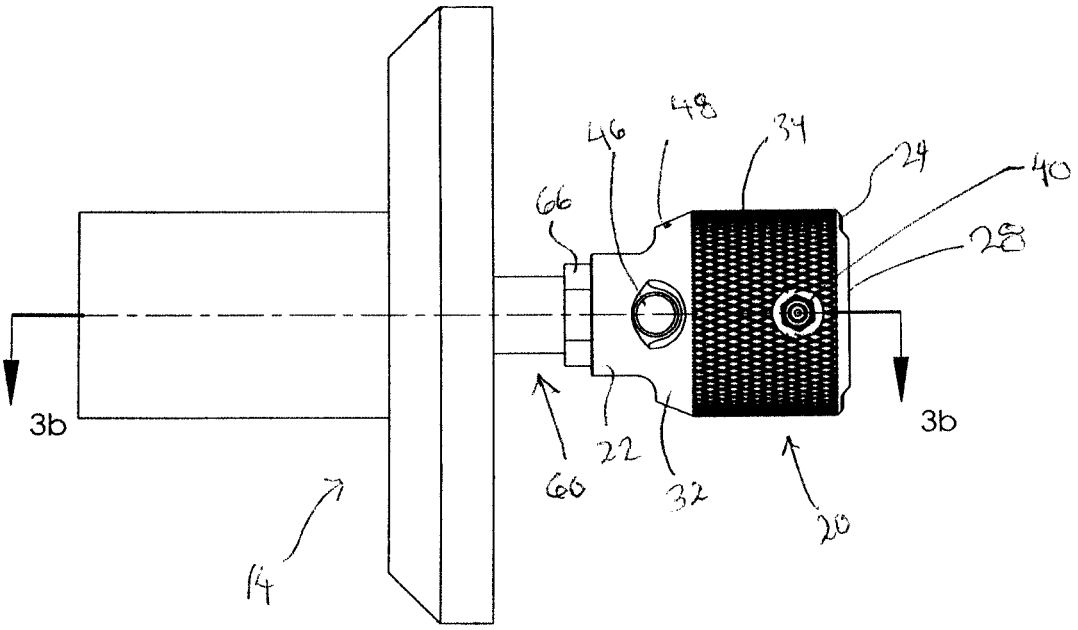
FIG. 3*a* is a top view of the bushing removal device as in FIG. 2*a;*
Figure 3B:
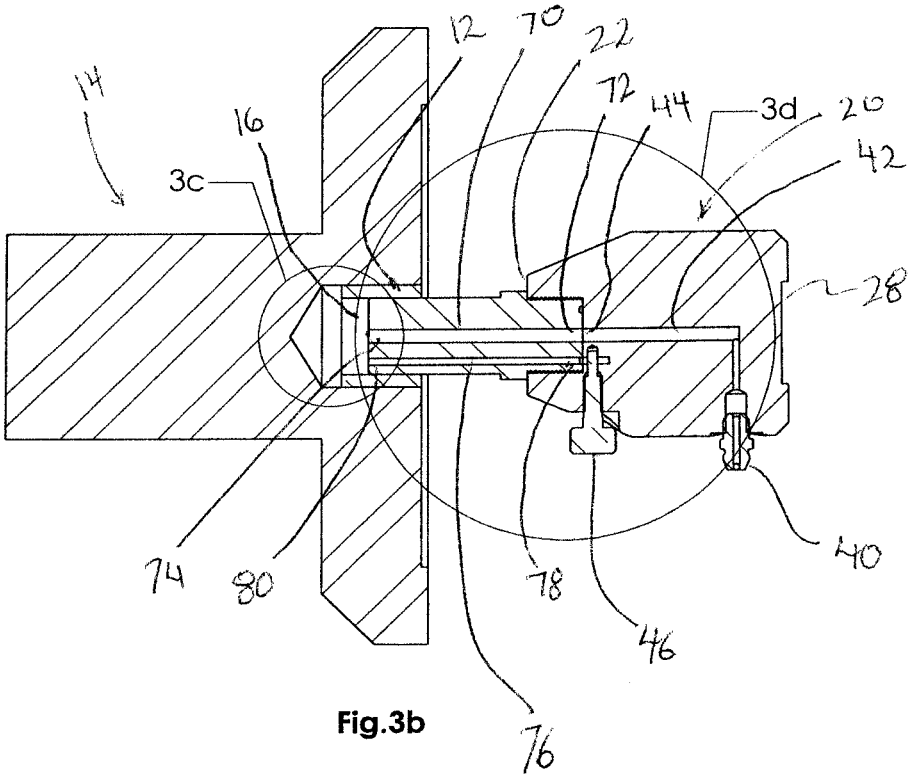
FIG. 3*b* is a sectional view taken along line 3*b*-3*b* of FIG. 3*a;*

On drawing Sheet 4 of 8, replace the informal drawing of Figs. 3a-3b with formal drawing of Figs. 3a-3b. (Attached)

Figure 3C:
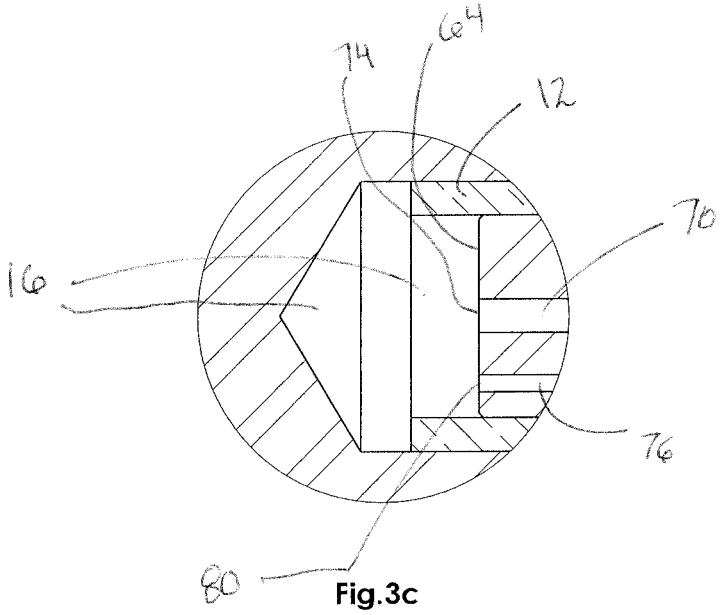
FIG. 3*c* is an isolated view on an enlarged scale of a portion of the bushing removal device as in FIG. 3*b;*
Figure 3D:
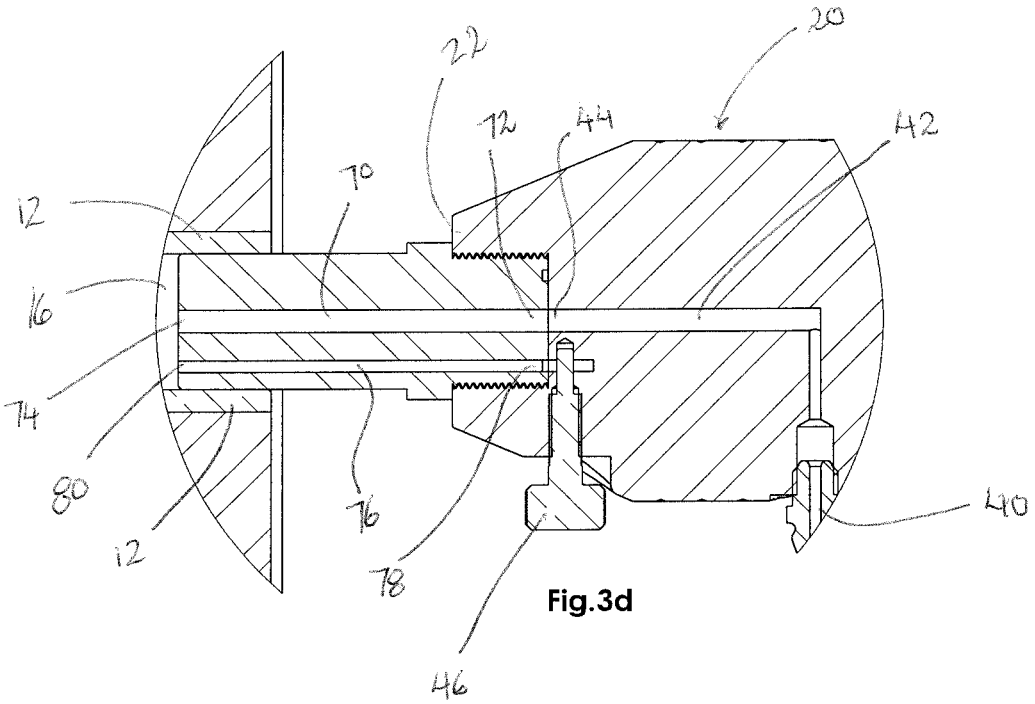
FIG. 3*d* is an isolated view on an enlarged scale of a portion of the bushing removal device as in FIG. 3*b;*

On drawing Sheet 5 of 8, replace the informal drawing of Figs. 3c-3d with formal drawing of Figs. 3c-3d. (Attached)

Figure 4A:
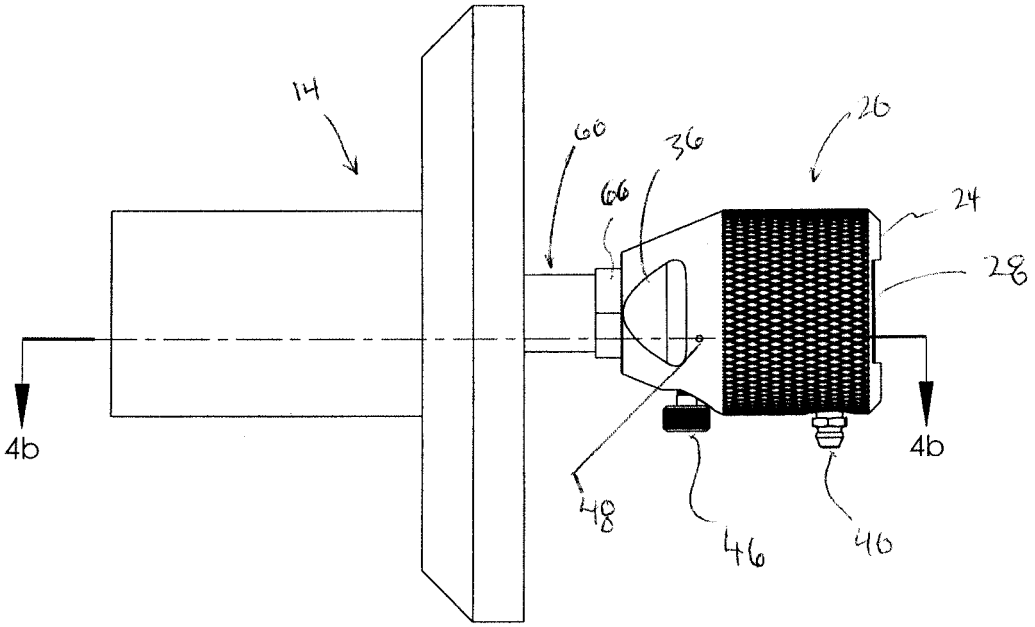
FIG. 4*a* is a top view of the bushing removal device as in FIG. 2*a;*
Figure 4B:
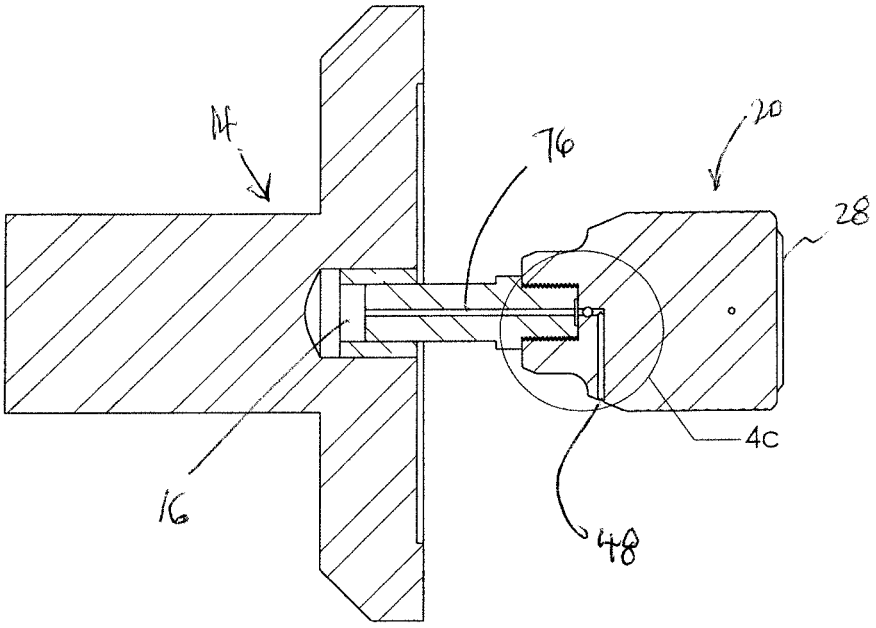
FIG. 4*b* is a sectional view taken along line 4*b*-4*b* of FIG. 4*a;*
Figure 4C:
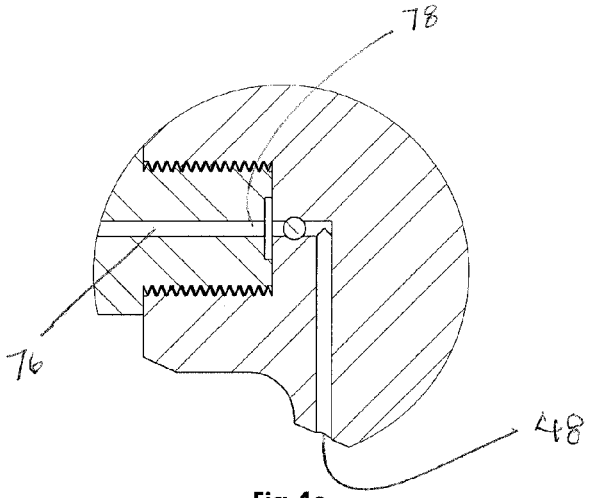
FIG. 4*c* is an isolated view on an enlarged scale of a portion of the bushing removal device as in FIG. 4*b;*
Figure 4D:
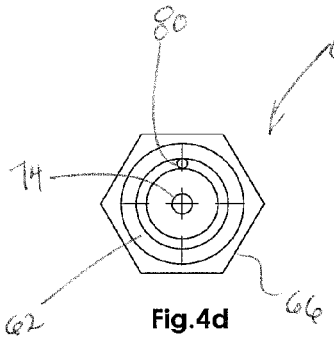
FIG. 4*d* is an end view of the proximal end of the nozzle of FIG. 1.
Figure 4E:
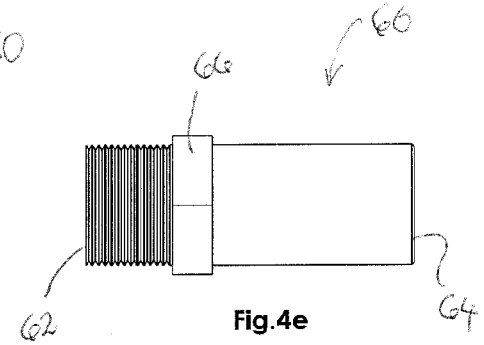
FIG. 4*e* is a side view of the nozzle as shown in FIG. 1.
Figure 4F:
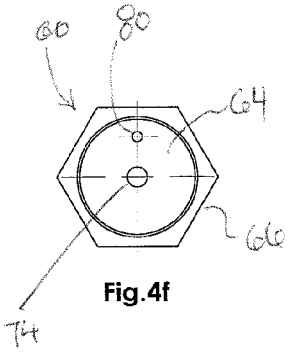
FIG. 4*f* is an end view of the distal end of the nozzle of FIG. 1.

On drawing Sheet 6 of 8, replace the informal drawing of Figs. 4a-4b with formal drawing of Figs. 4a-4b. (Attached)

On drawing Sheet 7 of 8, replace the informal drawing of Figs. 4c-4f with formal drawing of Figs. 4c-4f. (Attached)

Figure 5B:
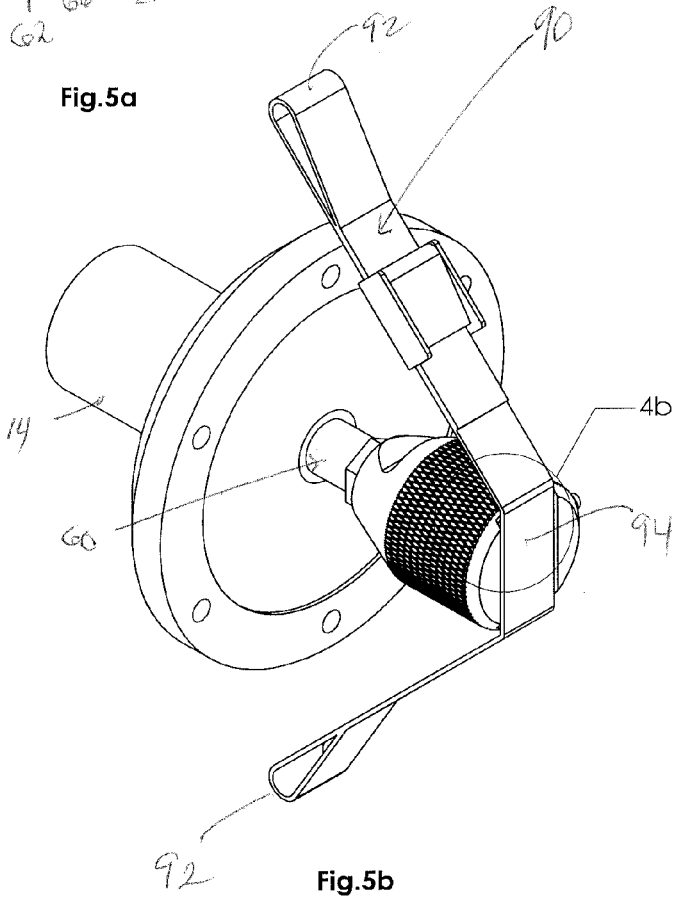
FIG. 5*b* is a perspective view of the bushing removal device as in FIG. 1 in use with a securing strap.
Figure 5C:
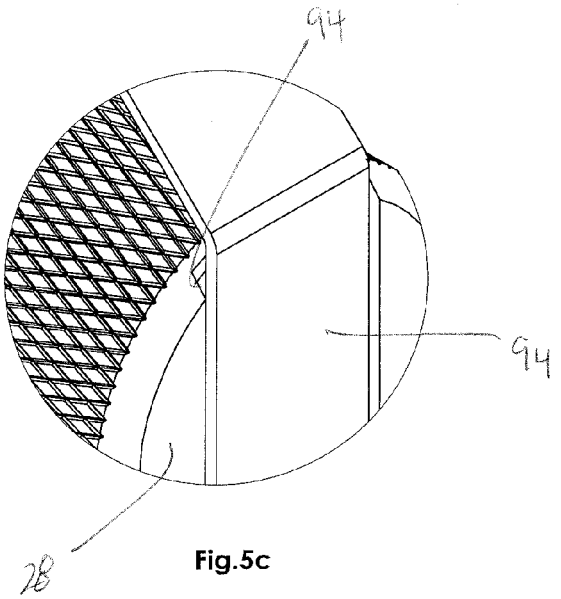
FIG. 5*c* is an isolated view on an enlarged scale of a portion of the bushing removal device as in FIG. 5*b.*
Figure 1:
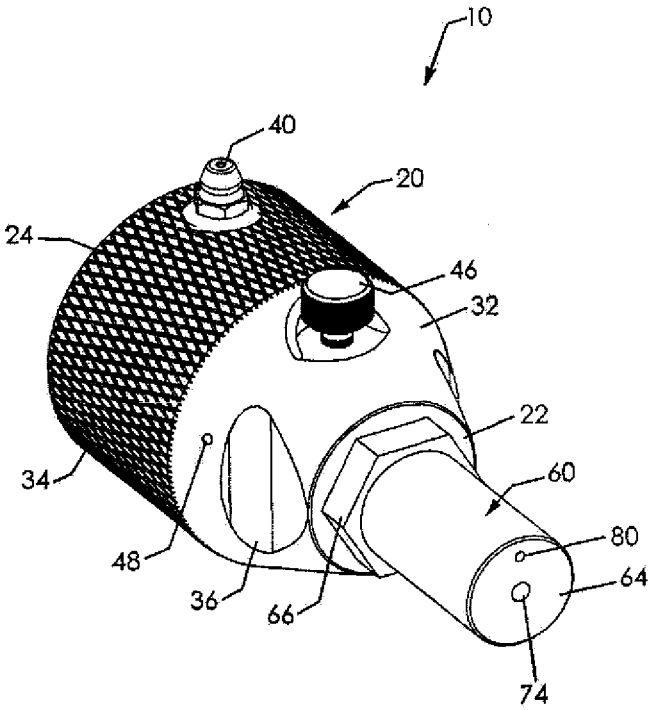
Figure 2A:
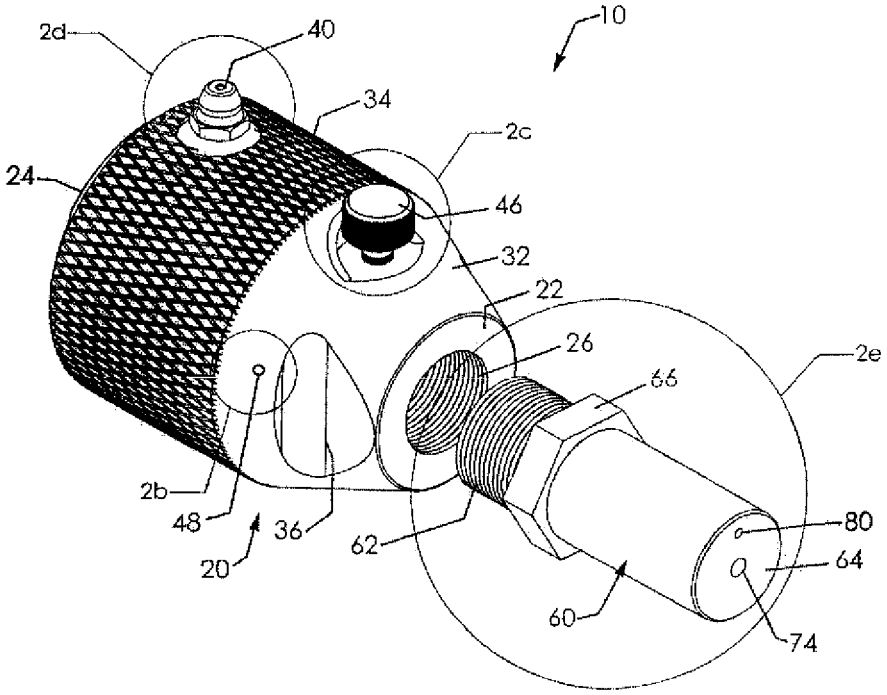
Figure 2B:
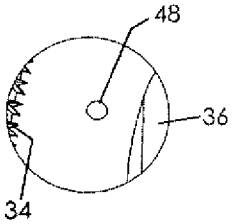
Figure 2C:
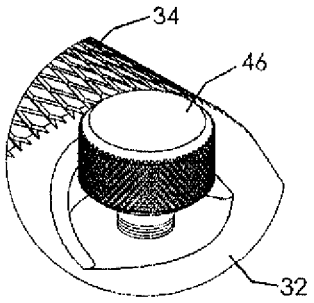
Figure 2D:
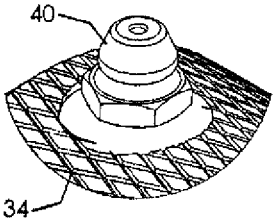
Figure 2E:
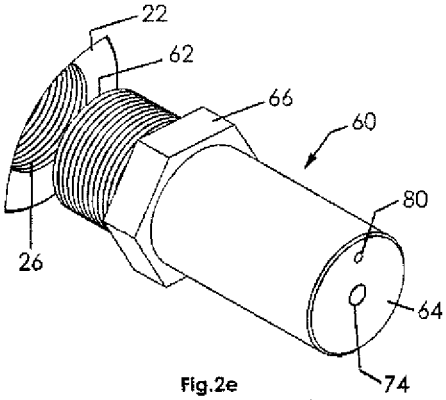
Figure 3A:
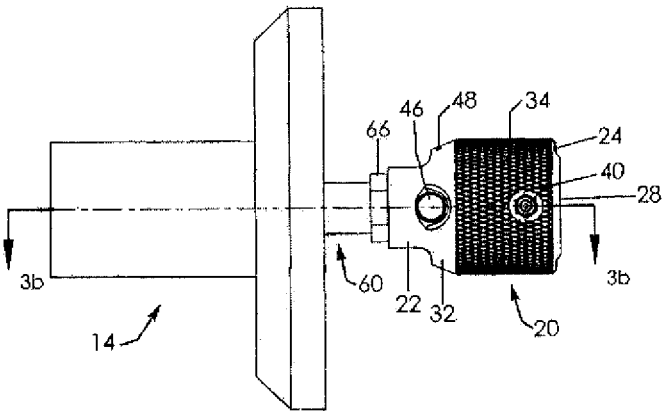
Figure 3B:
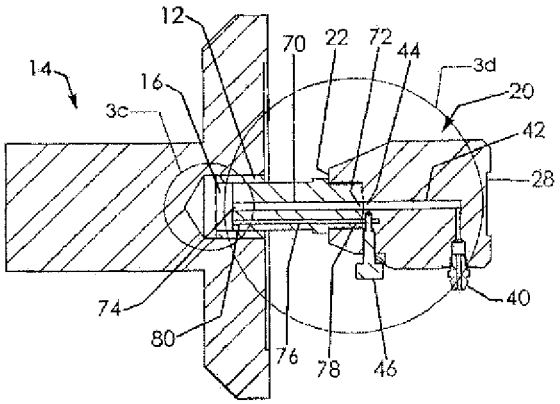
Figure 3C:
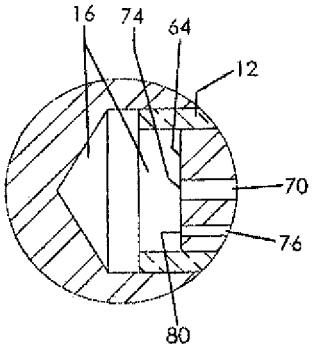
Figure 3D:
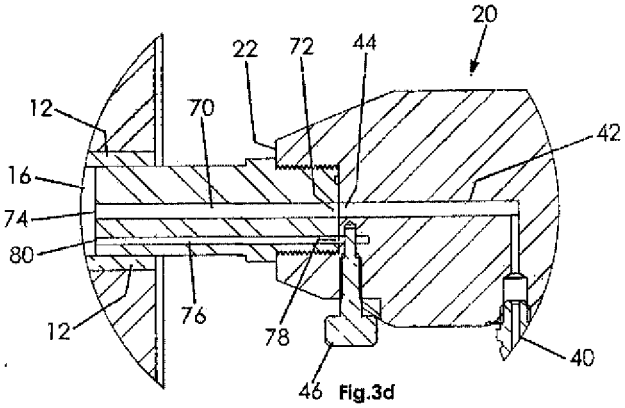
Figure 4A:
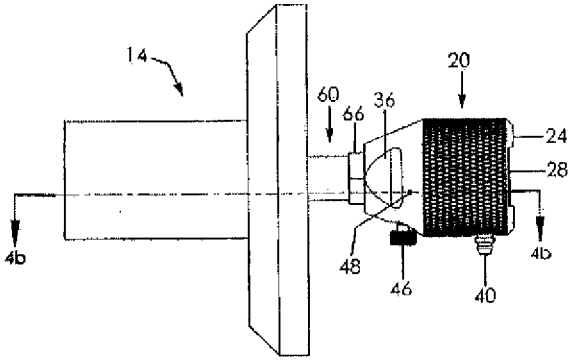
Figure 4B:
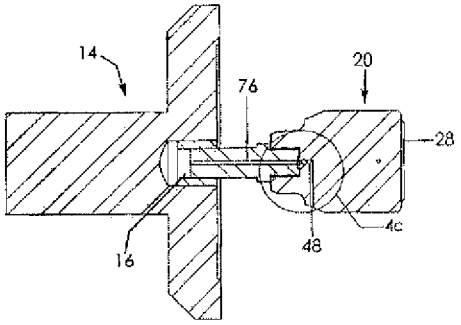
Figure 4C:
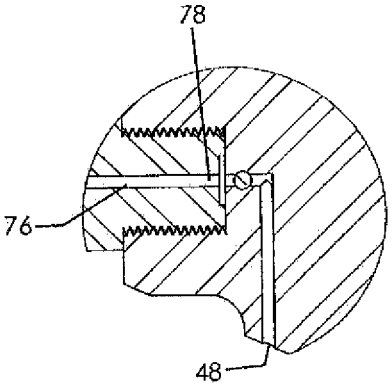
Figure 4D:
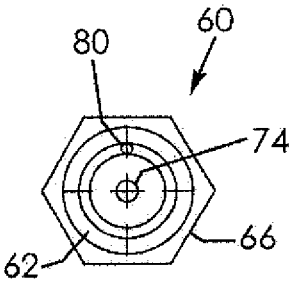
Figure 4E:
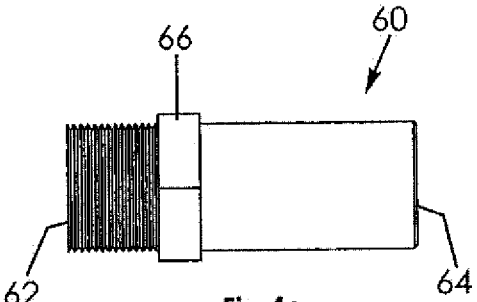
Figure 4F:
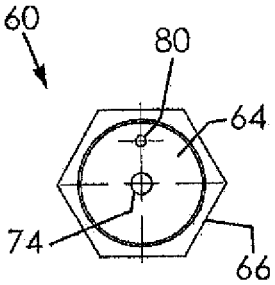

On drawing Sheet 8 of 8, replace the informal drawing of Figs. 5a-5c with formal drawing of Figs. 5a-5c. (Attached)

Signed and Sealed this
Tenth Day of May, 2016

Michelle K. Lee

Michelle K. Lee
*Director of the United States Patent and Trademark Office*

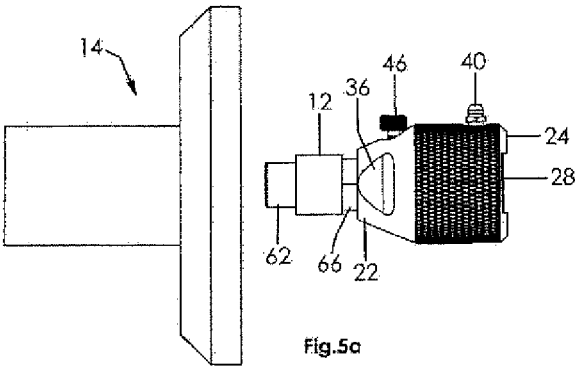
Fig.5a
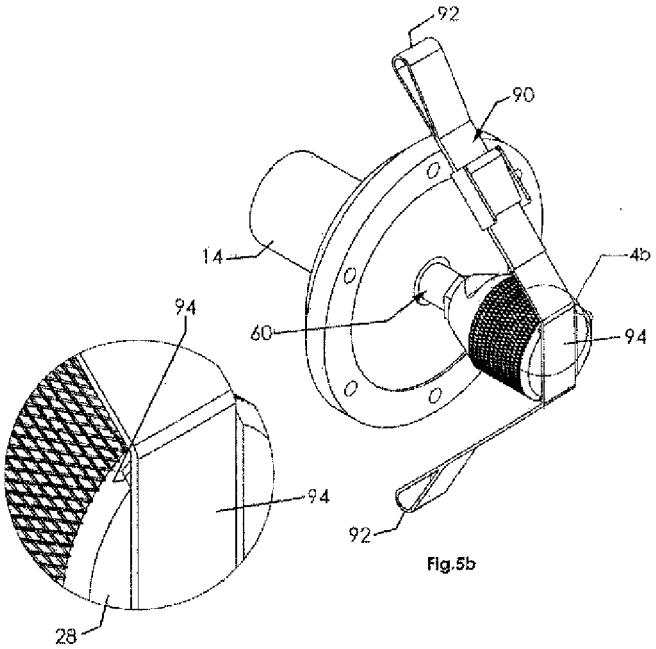
Fig.5b
Fig.5c